US005961234A

United States Patent [19]

Uchikata

[11] Patent Number: 5,961,234

[45] Date of Patent: Oct. 5, 1999

[54] SHEET CONVEYING APPARATUS

[75] Inventor: Yoshio Uchikata, Yokohama, Japan

[73] Assignee: Canon Kabushiki Kaisha, Tokyo, Japan

[21] Appl. No.: 08/984,190

[22] Filed: Dec. 3, 1997

[30] Foreign Application Priority Data

Dec. 6, 1996 [JP] Japan ..... 8-342443

[51] Int. Cl.[6] ..... B41J 13/02

[52] U.S. Cl. ..... 400/636; 400/641; 347/104

[58] Field of Search ..... 400/636, 636.3, 400/641; 347/104; 346/134, 136; 492/30, 33

[56] References Cited

U.S. PATENT DOCUMENTS

| | | | |
|---|---|---|---|
| 5,530,466 | 6/1996 | Fujioka et al. | 347/104 |
| 5,567,069 | 10/1996 | Suzuki et al. | 400/636 |
| 5,606,357 | 2/1997 | Bekki | 347/104 |

FOREIGN PATENT DOCUMENTS

| | | | |
|---|---|---|---|
| 60-187572 | 9/1985 | Japan | 400/641 |
| 61-192578 | 8/1986 | Japan | 400/641 |
| 1-286872 | 11/1989 | Japan | 400/641 |
| 8-165043 | 6/1996 | Japan . | |

OTHER PUBLICATIONS

IBM Technical Disclosure Bulletin, Self–Adjusting Document–Feed–Skew–Correction Device, vol. 35, No. 1B, Jun. 1992

*Primary Examiner*—Christopher A. Bennett
*Attorney, Agent, or Firm*—Fitzpatrick, Cella, Harper & Scinto

[57] ABSTRACT

A sheet discharge roller is formed from material having great rigidity such as metal and has discharge roller convey portions and discharge roller groove portions (circumferential grooves) to which spurs are opposed. The spurs are not contacted with the sheet discharge roller. The discharge roller convey portions are surface-finished to increase a friction force. There is provided a recording apparatus in which sheet conveying accuracy is improved without transferring ink to a sheet to thereby obtain a high quality image with high resolving power.

8 Claims, 8 Drawing Sheets

SHEET CONVEYING APPARATUS

BACKGROUND OF THE INVENTION

1. Field of the Invention

The present invention relates to a recording apparatus for recording an image on a sheet, for example, such as a printer, a copying machine, a facsimile, a word processor, an electronic typewriter, a computer and the like, and a sheet conveying apparatus used with such a recording apparatus.

2. Related Background Art

Conventionally, as recording apparatuses of this kind, for example, a recording apparatus of ink jet type for injecting ink onto a sheet in response to image information has been proposed. In such a recording apparatus of ink jet type (referred to as "ink jet recording apparatus" hereinafter), a recording medium (sheet) situated at a downstream side of a recording head in a sheet conveying direction is pinched between a convey roller or a member having spur-shaped projections on its outer peripheral surface and made of metal or resin or a member having disks made of material having high water-repellent ability (such members are referred to generically as "sheet hold-down member" hereinafter), and the sheet is conveyed by rotating the convey roller or the sheet hold-down member.

With the arrangement as mentioned above, after the ink is discharged from the recording head onto the sheet, even when the sheet hold-down member passes through on the ink adhered to the sheet in a condition that the ink is not adequately absorbed or dried, since, in the spur-shaped sheet hold-down member, only small areas of the tip ends of the projections are contacted with the sheet. And, since, in the disk-shaped sheet hold-down member, only sharp peripheral edges of the disks are contacted with the sheet and the member has the excellent water-repellent ability, the ink is not transferred to other portions on the sheet, thereby preventing the sheet from being smudged.

Further, there has been proposed a technique in which the sheet is conveyed by the sheet hold-down member while contacting the sheet hold-down member with a ink absorbing member to remove the ink adhered to the sheet hold-down member, thereby achieving the above-mentioned effect. Further, in a technique disclosed in the Japanese Patent Application Laid-open No. 8-165043, grooves are formed in the convey roller and the sheet hold-down member abuts against the grooves to clean the sheet hold-down member, thereby achieving the above-mentioned effect.

However, since the above-mentioned conventional sheet hold-down members have spur-shaped sharp projections or disks having sharp peripheral edges, the convey roller must be formed from material having small hardness such as rubber to prevent damage or wear of the sheet hold-down member. Thus, an outer diameter of the convey roller is varied with change in temperature due to linear expansion to change the conveying amount of the convey roller, or frictional coefficient of the convey roller is varied with change in temperature, endurance and time lapse to reduce the conveying force of the convey roller. Particularly when the recording is effected with high resolving power by the ink jet recording apparatus, unevenness in conveying accuracy caused by the above-mentioned problems affects a bad influence upon the image accuracy.

Further, when the absorbing member is urged against the sheet hold-down member, the rotation load of the sheet hold-down member is increased. When the grooves are formed in the convey roller and the sheet hold-down member abuts against the grooves, although the rotation load of the sheet hold-down member is not so increased, the cleaning ability is worsened in comparison with the usage of the absorbing member, and, thus, the service life of the apparatus is reduced.

SUMMARY OF THE INVENTION

The present invention aims to eliminate the above-mentioned conventional drawbacks, and has an object to provide a recording apparatus which can improve sheet conveying accuracy and permit the quality recording with high resolving power.

To achieve the above object, according to the present invention, there is provided a recording apparatus comprising a recording means for recording an image on a sheet and a convey means for conveying the sheet on which the image was recorded by the recording means. The convey means comprises a sheet convey rotary member formed from a rigid body including a surface portion formed to increase a friction force, a plurality of circumferential grooves, and a plurality of sheet hold-down rotary members opposed to the circumferential grooves in such a manner that they can be penetrated inside of the surface portion by means of biasing means.

According to the present invention, the configuration (such as outer diameter) of the sheet convey rotary member is not changed by change in environment (such as change in temperature) because the convey rotary member is formed from the rigid body, and, since the surface portion provides the high friction force, the high friction force can be apply to the sheet. Further, since the sheet hold-down rotary members penetrate into the circumferential grooves, a bad influence is not affected upon the surface portion.

The sheet hold-down rotary members penetrate into the circumferential grooves to an extent that the rotary members are not contacted with surfaces defining the circumferential grooves. And, it is preferable that, when the sheet is conveyed, the sheet hold-down rotary members can be shifted outwardly by the sheet in opposition to the biasing means. Accordingly, the sheet hold-down rotary members are not worn by the sheet convey rotary member.

Further, it is preferable that widths of the circumferential grooves are selected to have several values and, even when the sheet hold-down rotary members (among all of the sheet hold-down rotary members) opposed to the circumferential grooves having the predetermined widths are shifted outwardly by the sheet being conveyed, such sheet hold-down rotary members are positioned inside of the surface portion. In this case, even if the sheet to be conveyed becomes slack due to absorption of water, tension can be applied to the sheet to prevent the sheet from floating.

In a contain where cleaning members for removing contamination on the sheet hold-down rotary members are provided on the surfaces defining the circumferential grooves and the sheet hold-down rotary members are contacted with the cleaning members by means of the biasing means, and, when the sheet is conveyed, the sheet hold-down rotary members may be shifted outwardly by the sheet in opposition to the biasing means. In this case, the contamination on the sheet hold-down rotary members can be removed by the cleaning members, and, when the sheet is conveyed, the load acting on the sheet hold-down rotary members is not increased by the sheet convey rotary member.

In order to increase the friction force of the surface portion, small indentations may be formed on the surface portion. In this case, the friction force can be increased by abutting the sheet against the indentations.

In order to increase the friction force of the surface portion, a thin resin film may be coated on the surface portion. In this case, the friction force can be increased by the thin resin film.

The recording means may be of ink jet type in which ink is injected in response to image information.

DETAILED DESCRIPTION OF THE PREFERRED EMBODIMENTS

The present invention will now be fully explained in connection with embodiments thereof with reference to the accompanying drawings. However, dimensions, materials, configurations and relative position of constructural elements are not limited to such embodiments so long as such elements are specially defined.

(First Embodiment)

FIGS. 1, 2, 3, 4A, 4B, 5A and 5B show a first embodiment of the present invention. In this embodiment, an ink jet recording apparatus is shown.

Figure 1:
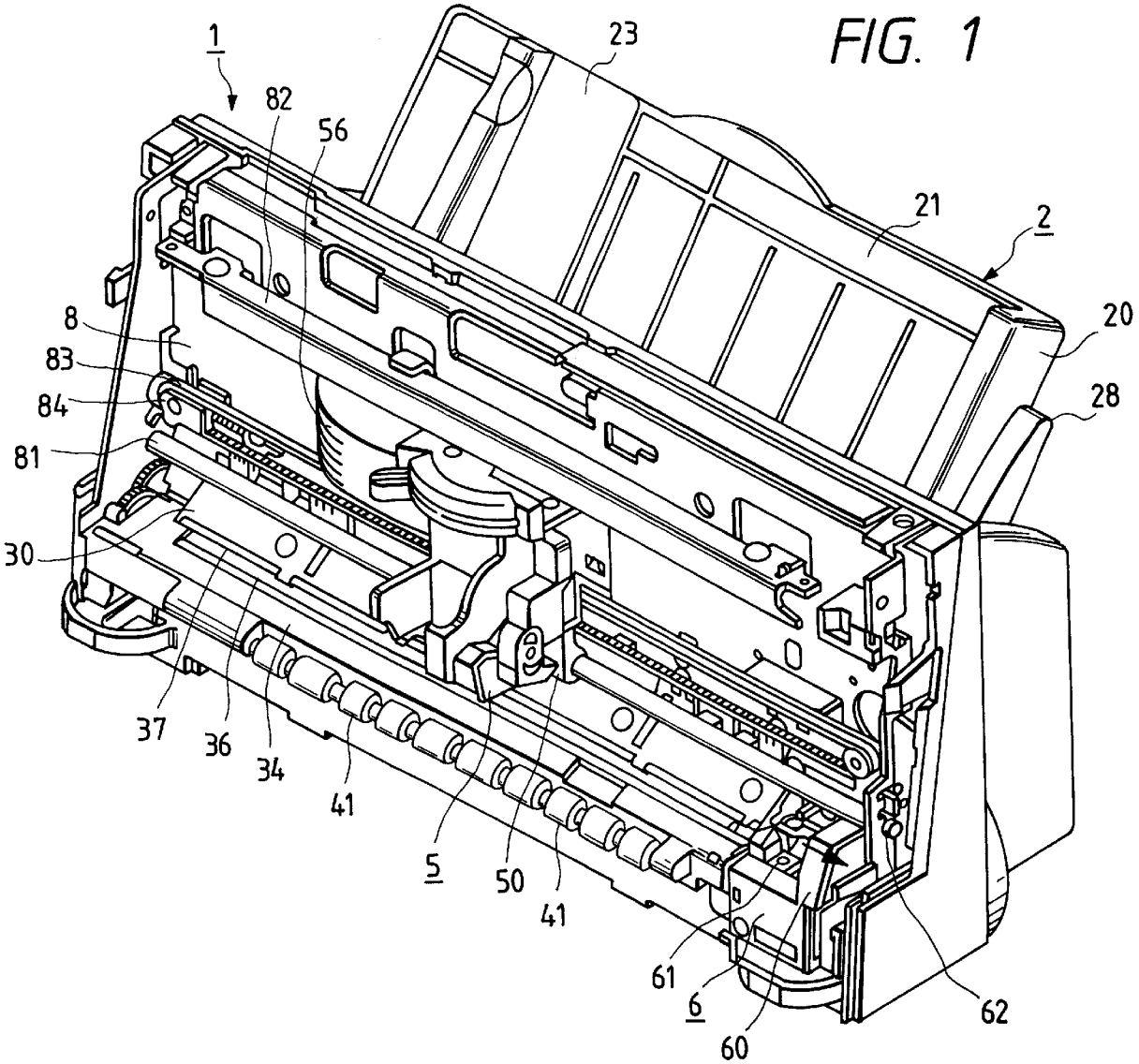
FIG. 1 is a perspective view of an ink jet recording apparatus according to a first embodiment of the present invention.
Figure 2:
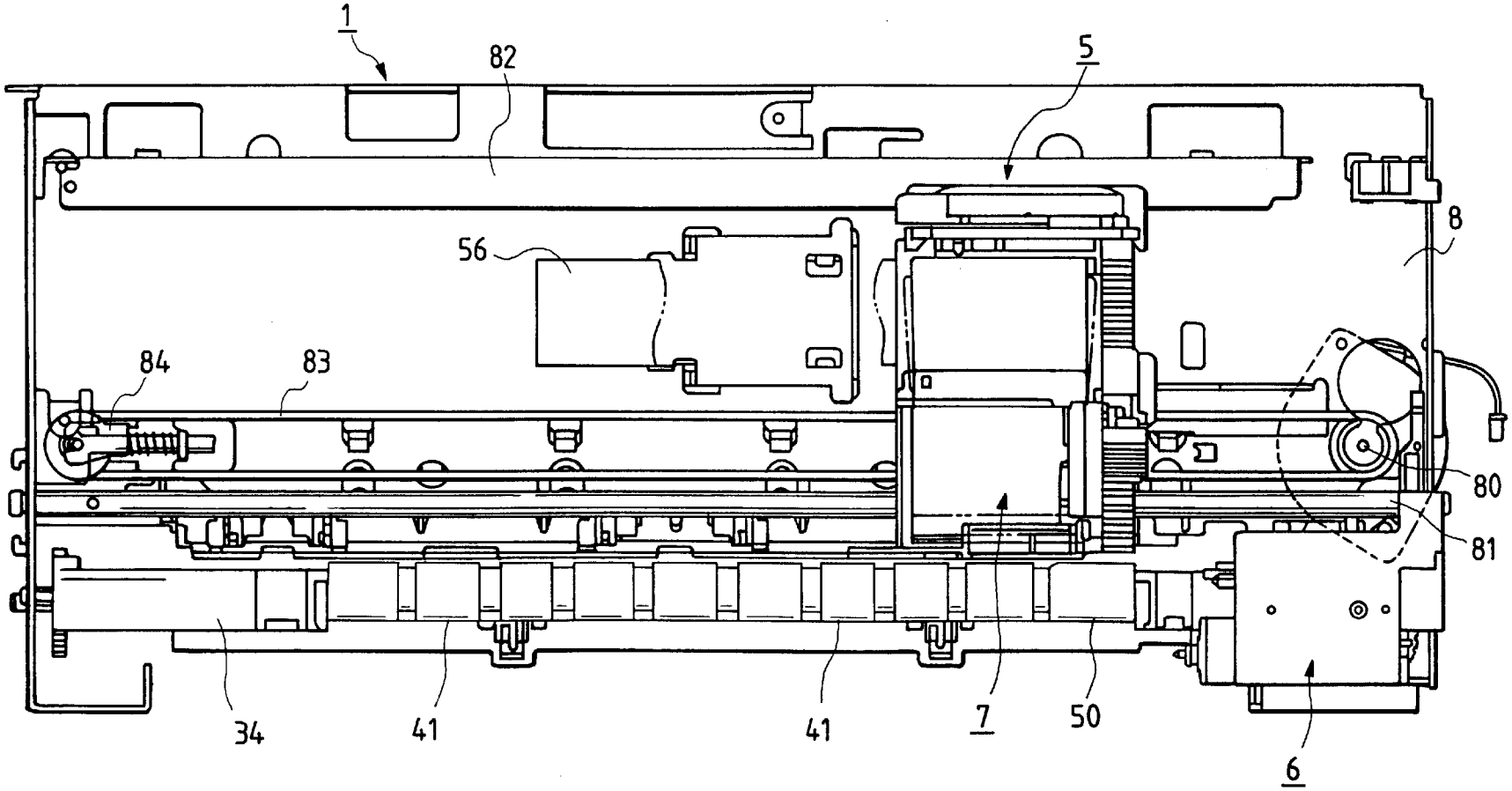
FIG. 2 is a front view of the ink jet recording apparatus of FIG. 1.
Figure 3:
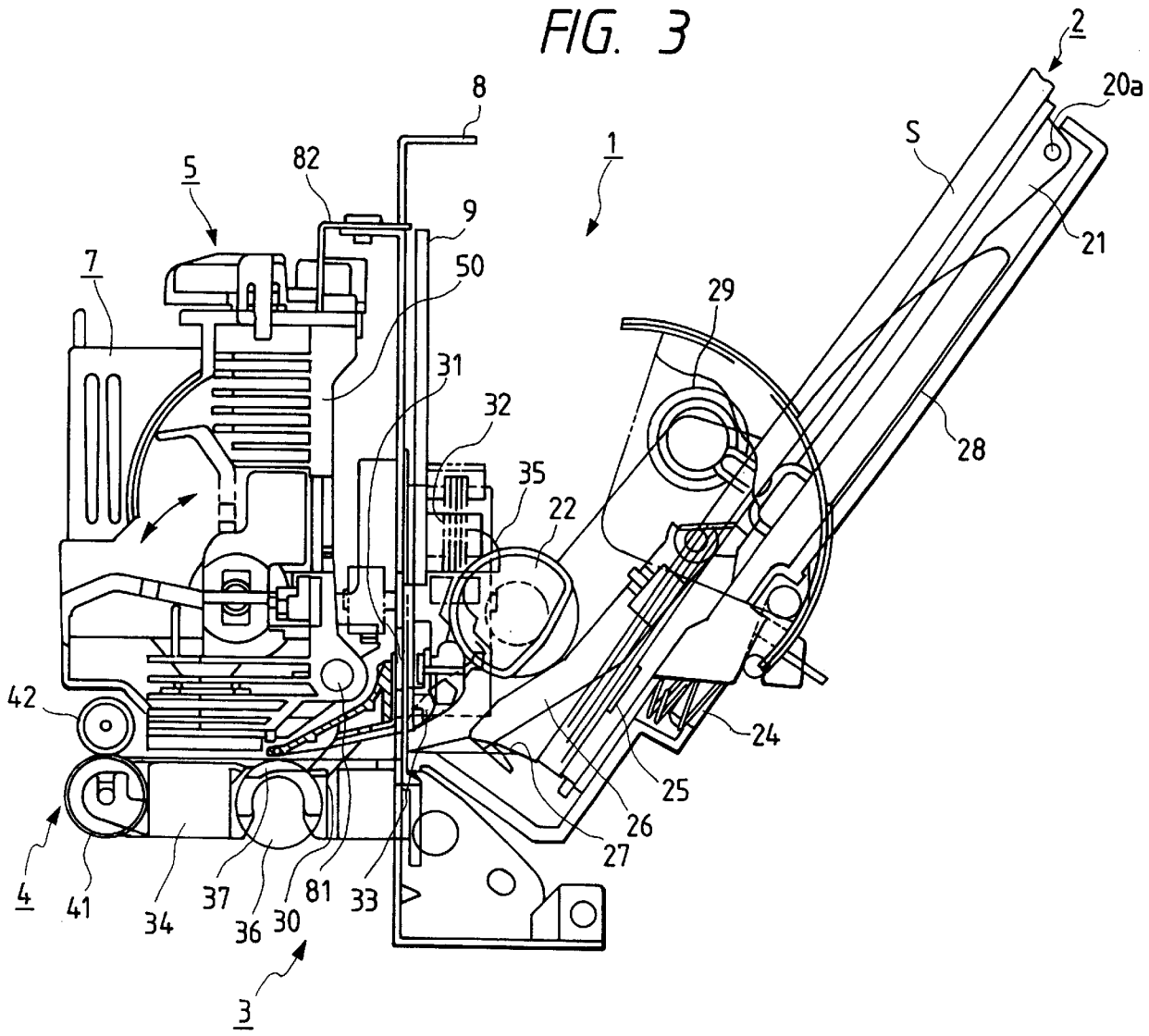
FIG. 3 is a sectional view of the ink jet recording apparatus of FIG. 1.

Incidentally, in this embodiment, an ink jet recording apparatus having an automatically sheet supplying apparatus is shown. As shown in FIGS. 1 to 3, the recording apparatus 1 comprises a sheet supply portion 2, a sheet feed portion 3, a sheet discharge portion (as a convey means) 4, a carriage portion 5, and a recovery portion 6. Now, these portions will be fully explained in order.

(Sheet Supply Portion)

The sheet supply portion 2 includes a pressure plate 21 on which recording sheets S are stacked, and a supply rotary member 22 attached to a base 20 to supply the recording sheet S. A movable side guide 23 is provided on the pressure plate 21 for shifting movement to thereby regulate a stack position of the shade stack S. The pressure plate 21 can be rotated around a rotary shaft 20*a* connected to the base 20 and is biased toward the supply rotary member 22 by a biasing force of a pressure plate spring 24.

Separation pads 25 made of material having high coefficient of friction (such as synthetic leather) for preventing double-feed of sheets are provided on portions of the pressure plate 21 opposed to the supply rotary member 22. Further, the base 20 is provided with a separation pawl 26 for regulating one of front corners of the sheet stack S and for separating thin sheets (for example, normal sheets) one by one, a bank portion 27 formed integrally with the base 20 to separate thick sheets (cannot be separated by the separation pawl) one by one, a switch lever 28 for switching the separation pawl in such a manner that the separation pawl 26 operates at a normal sheet position and does not operate at a thick sheet position, and a release cam 29 for releasing engagement between the pressure plate 21 and the supply rotary member 22.

In the above-mentioned arrangement, in a waiting condition, since the pressure plate 21 is lowered to a predetermined position by the release cam 29, the recording sheet stack S on the pressure plate 21 is separated from the supply rotary member 22. When a driving force from a convey roller 36 is transmitted to the supply rotary member 22 and the release cam 29 through a drive transmitting system (not shown) including a gear train, since the release cam 29 is disengaged from the pressure plate 21, the pressure plate 21 is lifted to urge the recording sheet stack S against the supply rotary member 22. When the supply rotary member 22 is rotated, the recording sheets S are picked up and are separated one by one by the separation pawl 26, and the separated recording sheet S is sent to the sheet feed portion 3.

The supply rotary member 22 and the release cam 29 are rotated until the recording sheet S is sent to the sheet feed portion 3. Thereafter, the waiting condition where the recording sheet stack S is separated from the supply rotary member 22 is restored, and the driving force from the convey roller 36 is not transmitted to the supply rotary member 22.

(Sheet Feed Portion)

The sheet feed portion 3 includes the convey roller 36 for conveying the recording sheet S, and a PE sensor 32. A driven pinch roller 37 is urged against the convey roller 36 from above. The pinch roller 37 is held by a pinch roller guide 30 so that the pinch roller 37 is urged against the convey roller 36 by biasing the pinch roller guide 30 by a pinch roller spring 31 to thereby generate a conveying force for the recording sheet S.

The convey roller 36 is formed from material having high rigidity such as metal (rigid body), and, grinding material is coated on the surface of the convey roller by electro-deposition or adhesive, or indentations are formed on the convey roller by sandblast, or a thin resin film having great friction coefficient is coated on the convey roller. With this arrangement, in comparison with the conventional rubber convey roller, dimensional accuracy of an outer diameter and whirling accuracy are improved, and the outer diameter of the convey roller is not changed due to change in temperature to thereby provide stable conveyance with high accuracy.

When convey roller 36 is formed from material having high rigidity such as metal and the grinding material is coated on the surface of the convey roller by electro-deposition or adhesive or the indentations are formed on the convey roller by sand-blast, it is desirable that the pinch roller 37 is formed from deformable material such as rubber. In this case, a contact area between the recording sheet S and the convey roller 36 is increased to increase the conveying force of the recording sheet S to thereby stabilize the conveyance.

A platen 34 and an upper guide 33 for guiding the recording sheet S are disposed in the vicinity of an inlet of the sheet feed portion 3 through which the recording sheet S is conveyed. A PE sensor lever 35 for transmitting detection of tip and trail ends of the recording sheet S to the PE sensor 32 is provided on the upper guide 33. The shiftable carriage portion 5 on which a recording head (recording means) 7 for forming an image in response to the image information is disposed at a downstream side of the convey roller 36 in a sheet conveying direction.

With the arrangement as mentioned above, the recording sheet S sent to the sheet feed portion 3 is guided by the platen 34, pinch roller guide 30 and upper guide 33 to be brought to a nip between the convey roller 36 and the pinch roller 37. In this case, the tip end of the recording sheet S is detected by the PE sensor lever 35 to thereby determine a recording position of the recording sheet S. The recording sheet S is conveyed on the platen 34 by rotating the convey roller pair 36, 37 by means of an LF motor (not shown).

The recording head 7 is of ink jet type in which ink is discharged in response to a signal and has a detachable ink tank. The recording head 7 further includes electro-thermal converters such as heaters for generating thermal energy for discharging the ink. The ink is film-boiled by the thermal energy generated by the electro-thermal converter, and the ink is discharged from a nozzle (ink discharge opening) of the recording head 7 by pressure change due to growth and contraction of a bubble formed by the film-boiling, thereby forming the image on the recording sheet S.

(Carriage Portion)

The carriage portion 5 includes a carriage 50 onto which the recording head 7 is attached. The carriage 50 is supported by a guide shaft 81 for reciprocally shifting the carriage in a direction perpendicular to the sheet conveying direction and a guide rail 82 for holding a trail end of the carriage 50 to maintain a gap between the recording head 7 and the recording sheet S. The guide shaft 81 and the guide rail 82 are attached to a chassis 8.

The carriage 50 is driven by a carriage motor 80 attached to the chassis 8 through a timing belt 83. The timing belt 83 is mounted on and supported by an idler pulley 84. Further, the carriage 50 has a flexible cable 56 for transmitting electric power and signals from an electric substrate 9 to the recording head 7.

With the arrangement as mentioned above, when the image is formed on the recording sheet S, after the recording sheet is conveyed to a line position for image formation (position along the sheet conveying direction) by driving the LF motor through the convey roller pair 36, 37, the recording head 7 is driven by the signal from the electric substrate 9 while shifting the carriage to a row position for image formation (position perpendicular to the sheet conveying direction) by the carriage motor 80. Thus, the recording head 7 discharges the ink toward the recording sheet S to form the image on the recording sheet.

(Recovery Portion)

The recovery portion S includes a cap 61 for converting the nozzles of the recording head 7 and for preventing the drying of the nozzles in an inoperative condition, a pump 60 connected to the carriage 60 to suck the ink from the nozzles of the recording head 7, and a wiper 62 for cleaning a nozzle surface of the recording head 7.

(Sheet Discharge Portion)

In the sheet discharge portion 4 providing characteristic of the illustrated embodiment, the convey roller 36 is connected to a sheet discharge roller (shade convey rotary member) 41 through a gear train (not shown), and the driving force of the LF motor is transmitted to the convey roller 36 and the sheet discharge roller 41 to thereby rotate the sheet discharge roller 41. Further, spurs (sheet hold-down members) 42 are biased toward the sheet discharge roller 41 by means of spur springs (not shown). The recording sheet S on which the image was formed in the carriage portion 5 is conveyed to be discharged onto a sheet discharge tray (not shown) while being pinched between the sheet discharge roller 41 and the spurs 42.

Now, the sheet discharge portion 4 will be fully explained with reference to FIGS. 4A and 4B. The spurs 42 cooperate with the sheet discharge roller 41 to pinch the recording sheet S therebetween for discharging the recording sheet. Each spur has a sharp spur-shaped projection or is formed as a disk having a sharp peripheral edge, so that the ink on the recording sheet S is not transferred. Further, when the spurs 42 are formed from resin having water-repellent ability or when water-repellent coating is applied on the surfaces of the spurs, the transferring of the ink can be further prevented.

The sheet discharge roller 41 is formed from material having high rigidity such as metal (rigid body) and has discharge roller convey portions 411 and discharge roller groove portions (circumferential grooves) 412 opposed to the spurs 42. The spurs 42 are arranged not to be contacted with the sheet discharge roller 41.

The discharge roller convey portions 411 are surface-finished to increase a friction force. To this end, grinding material is coated on the surfaces of the discharge roller convey portions by electro-deposition or adhesive to provide indentations (FIG. 5A), or indentations are formed on the discharge roller convey portions by sand-blast (FIG. 5B), or a thin resin film having great friction coefficient is coated on the discharge roller convey portions. The height of the indentations preferably has surface roughness (Rz) of about 25 to 100 $\mu$m, so that, when the sheet is conveyed, the friction force can be increased by conveying the sheet while urging the sheet against the indentations.

By forming the discharge roller convey portions 411 in this way, in comparison with the conventional rubber convey roller, dimensional accuracy of an outer diameter and whirling accuracy are improved, and the outer diameter of the sheet discharge roller is not changed due to change in temperature. Thus providing stable conveyance with high accuracy.

Figure 4A:
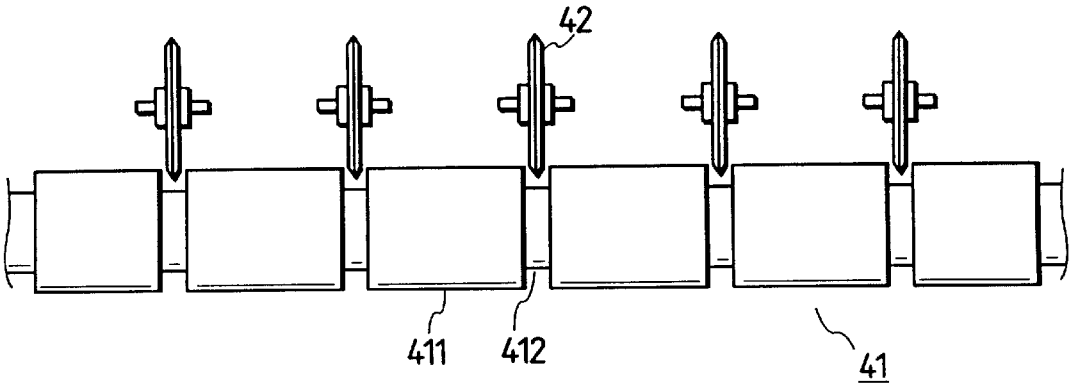
FIGS. 4A and 4B are enlarged views showing a part of the ink jet recording apparatus according to the first embodiment of the present invention.
Figure 4B:
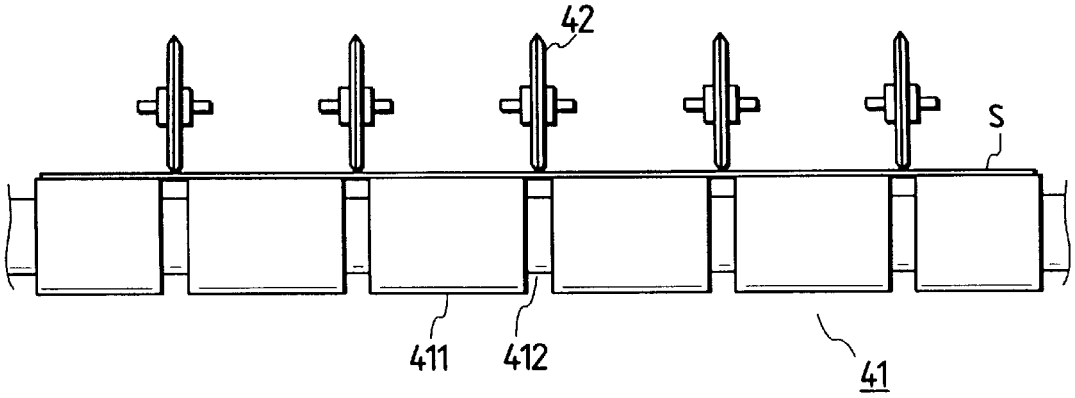
Figure 5A:
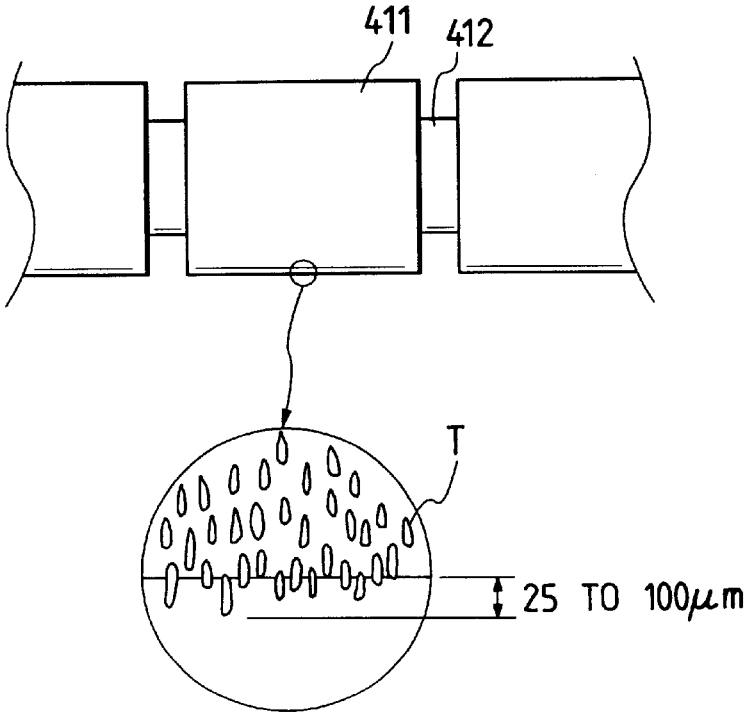
FIGS. 5A and 5B are further enlarged views showing a part of FIGS. 4A and 4B.
Figure 5B:
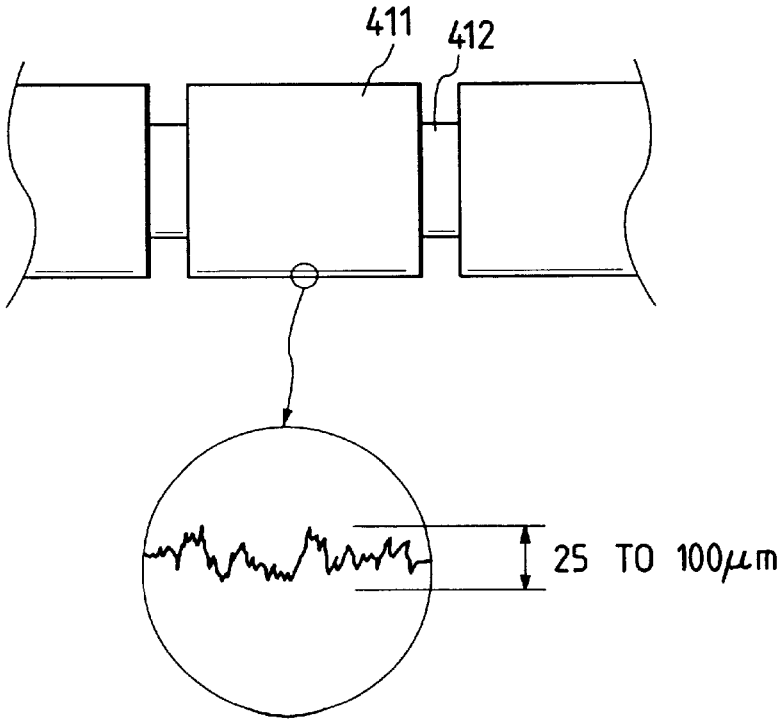

FIG. 4A shows a waiting condition of the recording apparatus 1 in which the recording sheet S is not pinched between the spurs 42 and the sheet discharge roller 41. In this condition, the spurs 42 are penetrated into the discharge roller groove portions 412 inside of the surfaces of the discharge roller convey portions 411 but are not contacted with surfaces defining the discharge roller groove portions 412. On the other hand, FIG. 4B shows a condition that the recording sheet S on which the image was recorded is pinched between the spurs 42 and the sheet discharge roller 41. In this condition, the spurs 42 urges the recording sheet S against the discharge roller convey portions 411 by biasing forces of spur springs (not shown) so that the recording sheet S can be conveyed by rotation of the sheet discharge roller 41.

By setting widths of the discharge roller groove portions 412 to about 10 mm or less, the spurs 42 can be shifted outwardly by the tension in the recording sheet S in opposition to the biasing forces of the spur springs (not shown)

to remove the slack from the recording sheet. Thus, a contacting condition between the recording sheet S and the discharge roller convey portions 411 is improved.

With the arrangement as mentioned above, the recording sheet S can be conveyed with high conveying accuracy without being influenced by the change in environment to thereby obtain an output image having high quality. Further, since the spurs 42 are not contacted with the sheet discharge roller 41, the service life of the spurs 42 can be increased. In addition, the ink transferred to the spurs 42 can be prevented from being transferred to the sheet discharge roller 41 to thereby preventing the ink contamination of a rear surface of the recording sheet S.

(Second Embodiment)

Figure 6A:
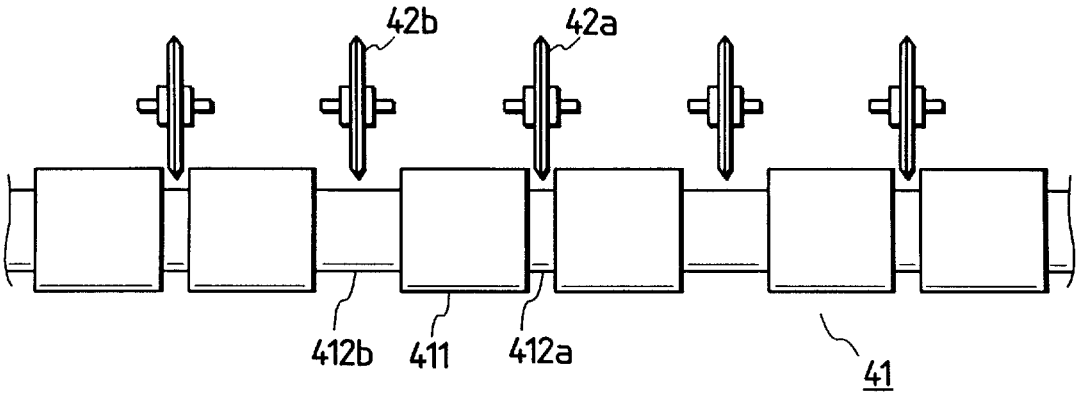
FIGS. 6A and 6B are enlarged views showing a part of an ink jet recording apparatus according to a second embodiment of the present invention.
Figure 6B:
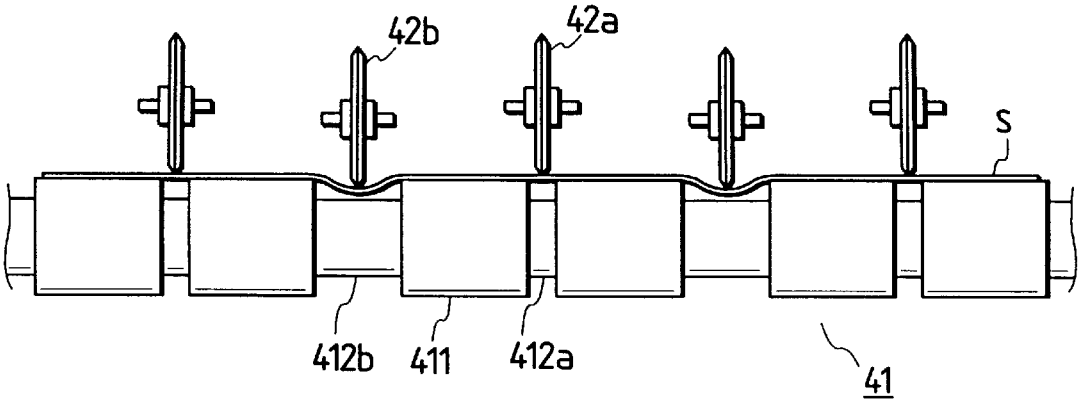

FIGS. 6A and 6B show a second embodiment of the present invention. In this embodiment, the circumferential grooves of the sheet discharge roller 41 have different axial widths. Since the other arrangement in the second embodiment is the same as that in the first embodiment, the same elements are designated by the same reference numerals and explanation thereof will be omitted. FIG. 6A is an enlarged view of a main part (sheet discharge portion) showing a condition that the sheet (recording sheet S) is not conveyed, and FIG. 6B is an enlarged view of the main part (sheet discharge portion) showing a condition that the sheet (recording sheet S) is conveyed.

Two kinds of axial widths are selected for the discharge roller groove portions (circumferential grooves) 412 (discharge roller groove portions 412*a* and discharge roller groove portions 412*b*), and spurs 42*a* are opposed to the discharge roller groove portions 412*a* and spurs 42*b* are opposed to the discharge roller groove portions 412*b*. In the discharge roller groove portions 412*a*, the width of each groove is selected to about 10 mm or less so that the spurs 42*a* can be shifted outwardly by the tension in the recording sheet S in opposition to the biasing forces of the spur springs (not shown) to remove the slack from the recording sheet. Thus a contacting condition between the recording sheet S and the discharge roller convey portions 411 to provide proper conveying accuracy is improved.

In the discharge roller groove portions 412*b*, by selecting the width of each groove to about 10 mm or more, even when the spurs 42*b* are shifted outwardly by the tension in the recording sheet S being conveyed in opposition to the biasing forces of the spur springs (not shown), the spurs are still remained inside of the surfaces of the discharge roller convey portions 411, thereby applying certain tension force to the recording sheet S.

With the arrangement as mentioned above, even if the recording sheet S is elongated (or becomes slack) due to absorption of ink during the recording operation, the recording sheet S is flexed by the spurs 42*b* to be entered into the discharge roller groove portions 412*b*, with the result that the recording sheet S can be prevented from floating (i.e., separating from the surfaces of the discharge roller convey portions 411). Thus, the contamination due to interference between the recording sheet S and the recording head 7 is prevented.

In the illustrated embodiment, while an example that two kinds of discharge roller groove portions 412 having different axial widths are provided was explained, three or more kinds of discharge roller groove portions having different axial widths may be provided in dependence upon material of the sheet to be conveyed.

(Third Embodiment)

Figure 7A:
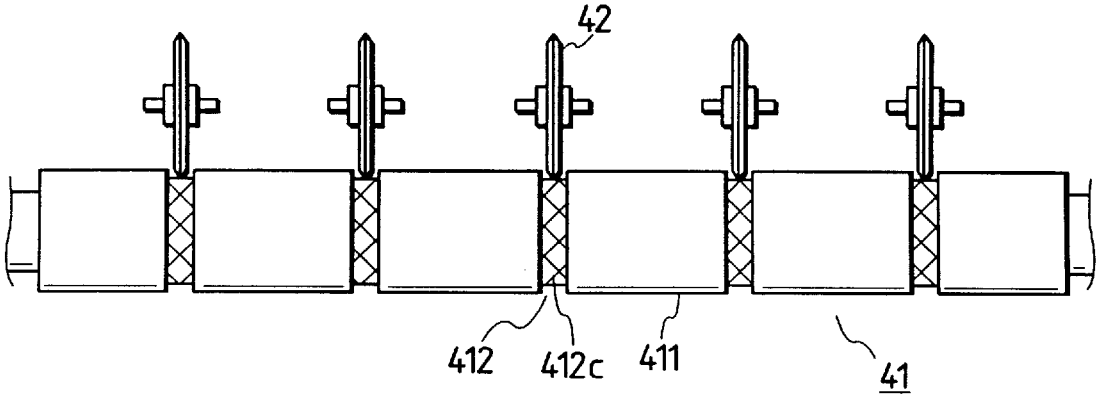
FIGS. 7A and 7B are enlarged views showing a part of an ink jet recording apparatus according to a third embodiment of the present invention.
Figure 7B:
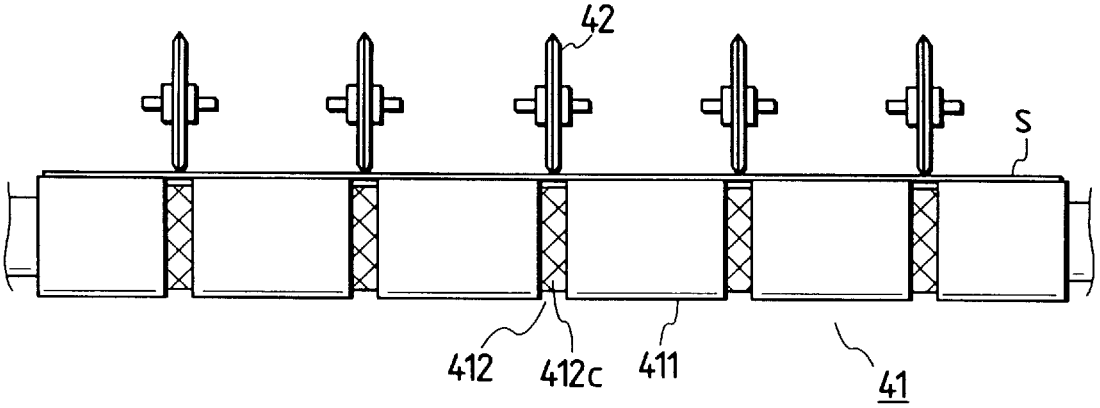

FIGS. 7A and 7B show a third embodiment of the present invention. In this embodiment, cleaning members are provided on the surfaces defining the circumferential grooves and the sheet hold-down members can abut against the cleaning members. Since the other arrangement in the third embodiment is the same as that in the first embodiment, the same elements are designated by the same reference numerals and explanation thereof will be omitted. FIG. 7A is an enlarged view of a main part (sheet discharge portion) showing a condition that the sheet (recording sheet S) is not conveyed, and FIG. 7B is an enlarged view of the main part (sheet discharge portion) showing a condition that the sheet (recording sheet S) is conveyed.

As shown in FIG. 7A, absorbing bodies (cleaning members) 412*c* are provided on bottoms of the discharge roller groove portions (circumferential grooves) 412. In the waiting condition of the recording apparatus 1 (i.e., the recording sheet S is not pinched between the spurs 42 and the sheet discharge roller 41), the spurs 42 are urged against the absorbing bodies 412*c*. On the other hand, FIG. 7B shows a condition that the recording sheet S on which the image was recorded is pinched between the spurs 42 and the sheet discharge roller 41. The arrangement and function are the same as those in the first embodiment.

Figure 8A:
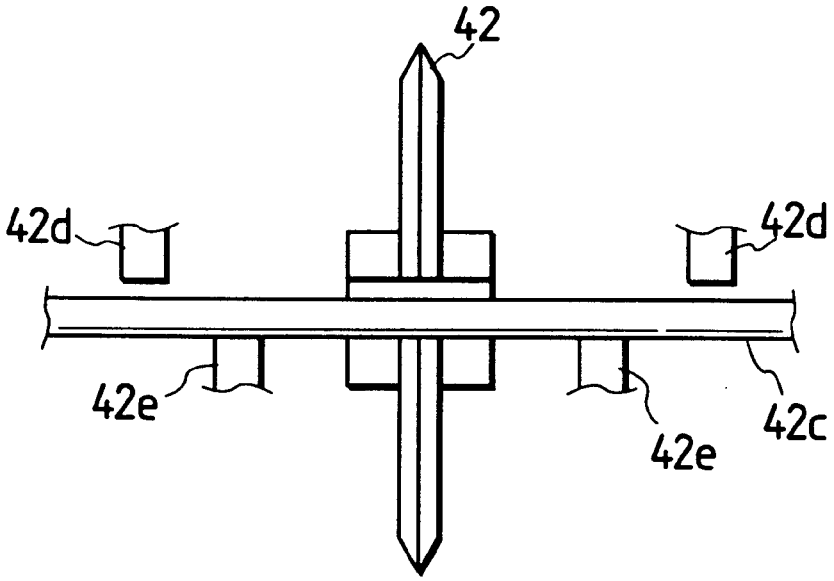
FIGS. 8A and 8B are views showing a spur supporting means.
Figure 8B:
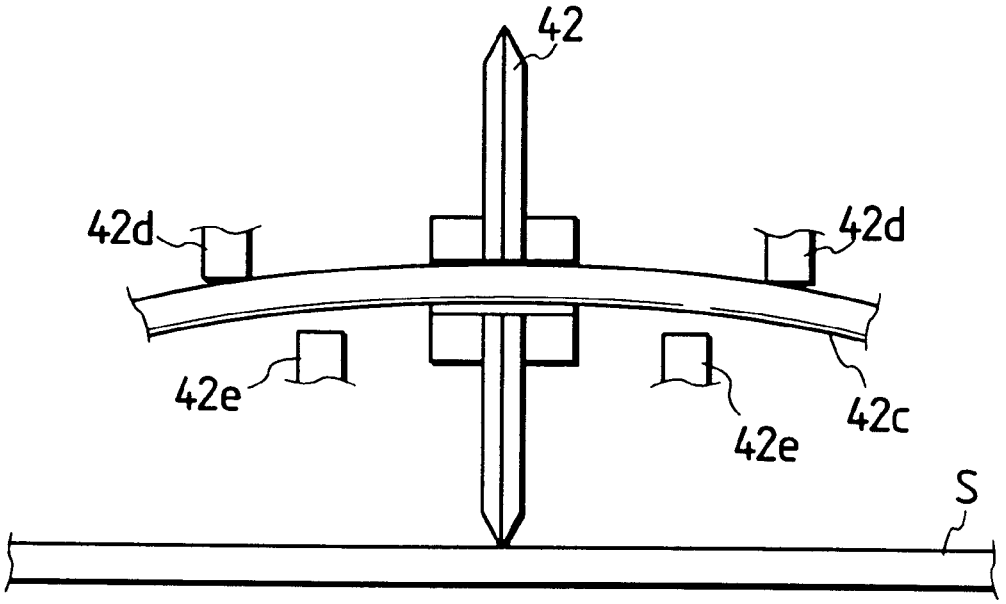

FIGS. 8A and 8B show support means for the spurs.

Each spurs 42 is rotatably supported on a elastically deformable shaft 42*c*. The shaft 42*c* is supported (in an up-and-down direction) by upper support portions 42*d* and lower support portions 42*e* provided on a frame of the recording apparatus and is also supported (in a direction perpendicular to the plane of FIG. 8A) by front support portions (not shown) and rear support portions (not shown). In this way, the position of each shaft is regulated.

FIG. 8A corresponds to FIGS. 4A, 6A and 7A and thus shows a condition that the recording sheet is not passed. In this condition, the shafts 42*c* are not elastically deformed, and, thus, the spurs 42*c* penetrate into the corresponding discharge roller groove portions 412 but are not contacted with the discharge roller groove portions. To the contrary, FIG. 8B corresponds to FIGS. 4B, 6B and 7B and thus shows a condition that the recording sheet is passed. In this condition, the shafts 42*c* are elastically deformed, and, due to reaction forces, the spurs 42 urge the recording sheet S against the sheet discharge roller 41.

In this embodiment, while an example that the shafts for supporting the spurs also act as spur springs was explained, the spurs or the spur shafts may be biased by shaft bearing leaf springs or coil springs. So long as the spurs are supported so that, when the springs are not elastically deformed, the spurs penetrate into the corresponding discharge roller groove portions but are not contacted with the discharge roller groove portions, when the recording sheet is passed, the springs are elastically deformed to bias the spurs. Alternatively, the spurs may always be biased toward the sheet discharge roller by the springs and there may be provided penetration regulating means for abutting against the springs, spur shafts or spur bearings so that the spurs penetrate into the corresponding discharge roller groove portions but are not contacted with the discharge roller groove portions when the recording sheet is not conveyed.

With the arrangement as mentioned above, since the ink adhered to the spurs are cleaned by the absorbing bodies 412*c*, the contamination is not accumulated on the spurs to thereby prevent the contamination of the recording sheet and to obtain a high quality output image.

It is desirable that the absorbing bodies 412*c* are formed from soft material to increase the service life of the spurs 42. Since the spurs 42 are spaced apart from the absorbing bodies 412*c* when the recording sheet S is conveyed, the conveyance load is not increased not to worsen the conveying accuracy for the recording sheet S.

As mentioned above, in the present invention, since the sheet convey rotary member is formed from rigid material, the configuration (such as outer diameter) of the rotary member is not changed by the change in environment (such as change in temperature). And, since the surface portion of the sheet convey rotary member has the great friction force, the great friction force can be applied to the recording sheet to improve the sheet conveying accuracy to thereby obtain a high quality image with high resolving power. Further, since the sheet hold-down members are penetrated into the circumferential grooves, the surface portion of the sheet convey rotary member is not influenced by the sheet hold-down members, so that the peripheral edges of the sheet hold-down members can be sharpened and the ink is not adhered to the sheet hold-down members. Thus, the ink from transferring to the recording sheet and thus improving the image quality is prevented.

When the sheet hold-down members are penetrated into the circumferential grooves to the extent that they are not contacted with the surfaces defining the circumferential grooves so that the sheet hold-down members can be shifted outwardly by the sheet in opposition to the biasing means when the sheet is conveyed, the sheet hold-down members are not worn by the sheet convey rotary member to thereby improve the image quality. By providing several kinds of axial widths of the circumferential grooves, the proper sheet conveyance can be maintained and, even if the slack is generated in the sheet being conveyed due to absorption of water or ink, the tension can be applied to the sheet to prevent the sheet from floating.

When the cleaning members are provided on the surfaces defining the circumferential grooves, since the sheet hold-down members are normally urged against the cleaning members by the biasing means and are shifted outwardly by the sheet in opposition to the biasing means (when the sheet is conveyed), the contamination of the sheet hold-down members can be cleaned to further improve the image quality. And since the rotational load of the sheet hold-down members is not increased by the sheet convey rotary member during the sheet conveyance, the stable conveying accuracy can be maintained.

In order to increase the friction force of the surface portion, the indentations may be formed on the surface portion against which the sheet is urged or the thin resin film may be coated on the surface portion. The recording means may be of ink jet type in which the ink is discharged toward the sheet in response to the image information.

What is claimed is:

1. A recording apparatus comprising:

recording means for recording an image on a sheet; and convey means for conveying the sheet on which the image was recorded by said recording means;

wherein said convey means includes a sheet convey rotary member formed from a rigid body including a surface portion formed to increase a friction force and a plurality of circumferential grooves; and a plurality of sheet hold-down rotary members provided to be opposed to each position of said circumferential grooves so that said sheet hold-down rotary members can be inserted by means of biasing means into said circumferential grooves to an extent that said sheet hold-down rotary members are not contacted with surfaces defining said circumferential grooves, and, when the sheet is conveyed, said sheet hold-down rotary members are shifted outwardly by the sheet against said biasing means.

2. A recording apparatus according to claim 1, wherein axial widths of said circumferential grooves are selected to have several values and, among all of said sheet hold-down rotary members, even when the sheet hold-down rotary members opposed to the circumferential grooves having the predetermined widths are shifted outwardly by the sheet being conveyed, such sheet hold-down rotary members are positioned inside of said surface portion.

3. A recording apparatus according to claim 1, wherein small indentations are provided on said surface portion to increase the friction force of said surface portion.

4. A recording apparatus according to claim 1, wherein a thin resin film is coated on said surface portion to increase the friction force of said surface portion.

5. A recording apparatus according to claim 1, wherein said recording means is of an ink jet type in which ink is injected toward the sheet in response to image information.

6. A sheet conveying apparatus comprising:

a convey rotary member formed from a rigid body for conveying a sheet;

hold-down rotary members for urging the sheet against said convey rotary member; and spring means for biasing said hold-down rotary members toward said convey rotary member, wherein a plurality of circumferential grooves are formed in an outer peripheral surface of said convey rotary member, and said hold-down rotary members are disposed at positions opposing said circumferential grooves and are supported so that said hold-down rotary members can be inserted into said circumferential grooves between said outer peripheral surface of said convey rotary member and a rotation center of said convey rotary member, and wherein when said spring means are not elastically deformed, said hold-down rotary members are inserted into said circumferential grooves but are not contacted with said circumferential grooves.

7. A sheet conveying apparatus according to claim 6, further comprising penetration regulating means for regulating penetration of said hold-down rotary members in opposition to biasing forces of said spring means so that said hold-down rotary members are not inserted to exceed a predetermined position where said hold-down rotary members are positioned within said circumferential grooves but are not contacted with said circumferential grooves.

8. A sheet conveying apparatus according to claim 6, wherein small indentations are provided on an outer surface of said convey rotary member to increase a friction force of said convey rotary member.

* * * * *

UNITED STATES PATENT AND TRADEMARK OFFICE

CERTIFICATE OF CORRECTION

PATENT NO. : 5,961,234

DATED : October 5, 1999

INVENTOR(S): YOSHIO UCHIKATA

It is certified that error appears in the above-identified patent and that said Letters Patent is hereby corrected as shown below:

COLUMN 1:
Line 40, "a" should read --an--.

COLUMN 2:
Line 30, "apply" should read --applied--;
Line 33, "affected" should read --exerted--; and
Line 53, "contain" should read --container--.

COLUMN 3:
Line 48, "automatically" should read --automatic--; and
Line 62, "shade" should read --sheet--.

COLUMN 6:
Line 46, "temperature. Thus" should read --temperature, thus--; and
Line 58, "urges" should read --urge--.

COLUMN 7:
Line 11, "preventing" should read --prevent--.

COLUMN 8:
Line 24, "spurs 42" should read --spur 42--, and "a" should read --an--; and

UNITED STATES PATENT AND TRADEMARK OFFICE

CERTIFICATE OF CORRECTION

PATENT NO. : 5,961,234

DATED : October 5, 1999

INVENTOR(S): YOSHIO UCHIKATA

It is certified that error appears in the above-identified patent and that said Letters Patent is hereby corrected as shown below:

COLUMN 8 (Cont.):
Line 60, "are" should read --is--.

COLUMN 9:
Line 2, "not" (2nd occurrence) should be deleted.

Signed and Sealed this

Eleventh Day of July, 2000

*Attest:*

Q. TODD DICKINSON

*Attesting Officer*

*Director of Patents and Trademarks*